US006117190A

United States Patent [19]

Chao et al.

[11] Patent Number: 6,117,190

[45] Date of Patent: Sep. 12, 2000

[54] REMOVING SOIL FROM FABRIC USING AN IONIZED FLOW OF PRESSURIZED GAS

[75] Inventors: Sidney C. Chao, Manhattan Beach; Nelson W. Sorbo, Redondo Beach; Edna M. Purer, Los Angeles, all of Calif.

[73] Assignee: Raytheon Company, Lexington, Mass.

[21] Appl. No.: 09/372,965

[22] Filed: Aug. 12, 1999

[51] Int. Cl.[7] ..... D06B 13/00; D06F 43/00

[52] U.S. Cl. ..... 8/137; 8/142; 8/149.2; 8/158; 8/159; 134/1.1; 134/10; 134/34; 134/37

[58] Field of Search ..... 8/137, 142, 158, 8/159, 149.2; 134/1.1, 10, 34, 37

[56] References Cited

U.S. PATENT DOCUMENTS

| | | |
|---|---|---|
| 4,685,930 | 8/1987 | Kasprzak . |
| 5,467,492 | 11/1995 | Chao et al. . |
| 5,651,276 | 7/1997 | Purer et al. . |
| 5,916,373 | 6/1999 | Schneider . |
| 5,925,192 | 7/1999 | Purer et al. . |

OTHER PUBLICATIONS

Institute of Environmental Sciences and Technology Contamination Control Division, "Electrostatic Charge in Cleanrooms and Other Controlled Environments IEST–R-P–CC022.1", Insitute of Environmental Science and Technology.

*Primary Examiner*—Margaret Einsmann

*Attorney, Agent, or Firm*—Colin M. Raufer; Leonard A. Alkov; Glenn H. Lenzen, Jr.

[57] ABSTRACT

A piece of soiled fabric is cleaned by contacting it with a jet of an ionized soil-dislodging gas to dislodge the soil therefrom. The ionized gas and the use of an oppositely charged electrostatic filter aid in preventing redeposition of the soil onto the fabric. The fabric may be agitated while it is contacted with the gas jet. A portion of the piece of fabric may be treated with an electrostatic spotting compound that enhances the effect of the ionized gas and may also enhance the removal of the soil. An apparatus for accomplishing the cleaning includes a container having an interior in which the fabric is received, a gas jet nozzle directed into the interior of the container, a source of a pressurized gas communicating with an inlet of the gas jet nozzle, a gas jet manifold extending from the source to the gas jet nozzle, and a gas ionizer disposed to ionize the pressurized gas passing through the gas jet nozzle.

14 Claims, 4 Drawing Sheets

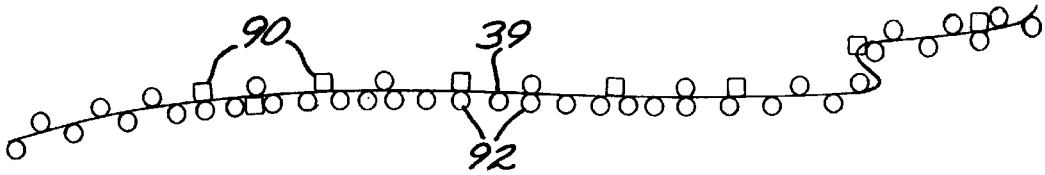
FIG.4A
FIG.4B
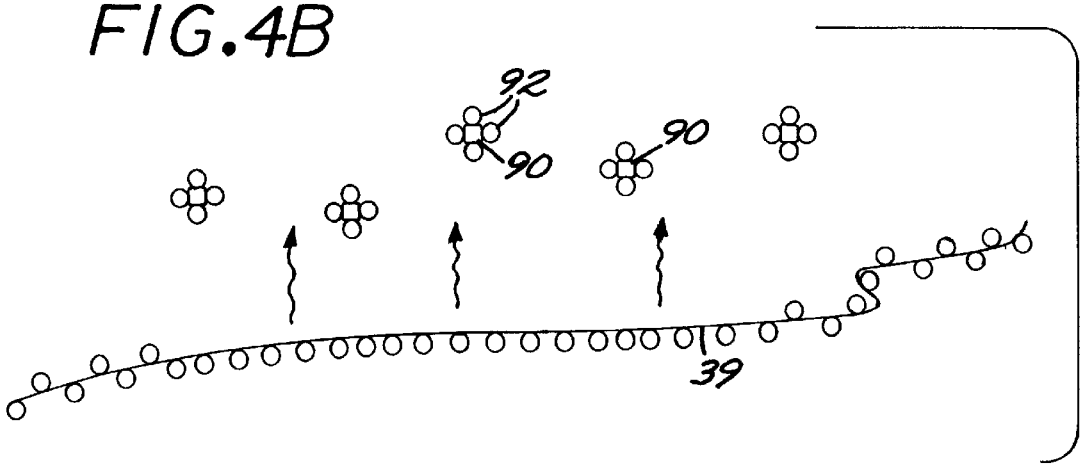
FIG.5A
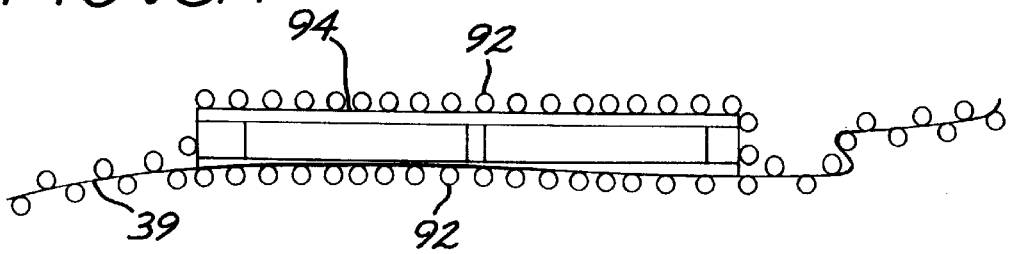

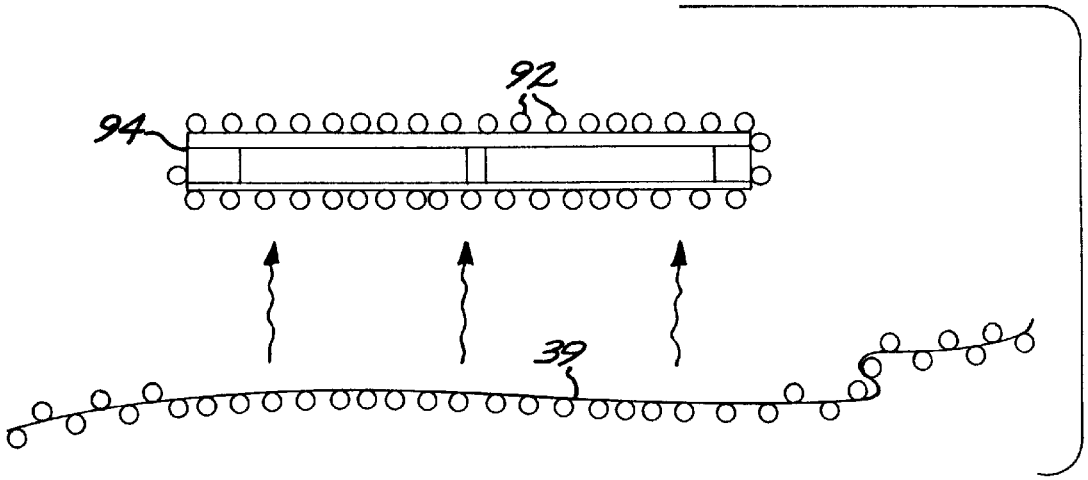
FIG. 5B
FIG. 6
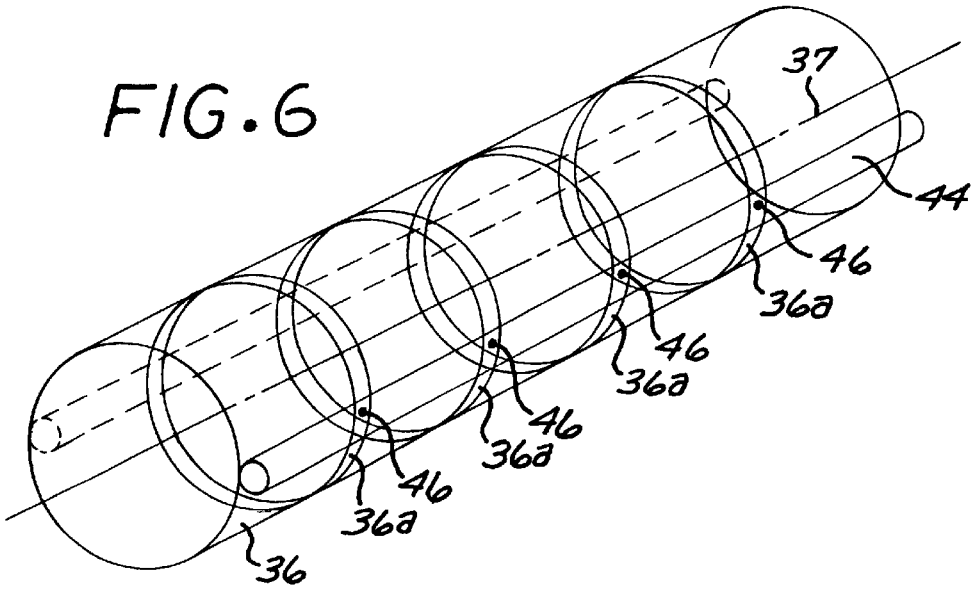

REMOVING SOIL FROM FABRIC USING AN IONIZED FLOW OF PRESSURIZED GAS

BACKGROUND OF THE INVENTION

This invention relates to the removal of soil from fabric, and, more particularly, to a process for improving the dislodging of soil from the fabric and preventing its redeposition onto the fabric.

Garment dry cleaning is currently performed commercially using organic solvents such as perchloroethylene or petroleum derivatives. These solvents pose a health hazard, are smog-producing, and/or are flammable. The use of dense-phase carbon dioxide (both liquid and supercritical) as a dry-cleaning solvent medium resolves the health and environmental concerns posed by conventional solvents. An additional benefit is that its use reduces secondary waste streams associated with processes that employ conventional solvents. A dry-cleaning process that uses liquid carbon dioxide as a cleaning medium is described in U.S. Pat. No. 5,467,492. In one embodiment, the fabric is placed into a perforated basket within a pressure vessel, and then submerged into a pool of liquid carbon dioxide. The liquid carbon dioxide and the fabric in the pool are agitated by an incoming flow of liquid carbon dioxide that induces a tumbling action of the fabric. The liquid carbon dioxide solvent promotes the removal of the soluble soils through their dissolution, and the mechanical action of the fabric tumbling promotes the expulsion of the soil.

One of the disadvantages of this liquid carbon dioxide process is that it must be performed within a pressure system, and thus has associated high capital costs. An apparatus and method are described in U.S. Pat. No. 5,651,276 to expel soils from fabrics by gas jets at ambient pressure. This gas jet process may be practiced using the apparatus of the liquid carbon dioxide process described above, as a step of an overall fabric dry-cleaning process, or in a separate, low-cost apparatus.

In this process, the dislodged soil is desirably entrained in the gas and thereafter removed in a mechanical filter. The gas jet process promotes the dislodging of the soil from the fabric, the entraining of the soil in the gas flow, and the collecting of the soil using a filter before it is redeposited back onto the fabric. Although existing gas jet techniques achieve these objectives to some extent, it is always desirable to improve the efficiency of the gas jet process even further.

There is a need for an approach that realizes the advantages of the gas jet process, while increasing the effectiveness of the dislodging of the soil from the fabric and reducing its redeposition back onto the fabric prior to removal of the soil from the gas flow by filtration. The present invention fulfills this need, and further provides related advantages.

SUMMARY OF THE INVENTION

The present invention provides an apparatus and method for cleaning soiled fabric using a gas jet. The approach improves the removal of soil from the fabric and also reduces the fraction of the dislodged soil that is redeposited back onto the fabric before it may be removed from the system by filtration. The present technique otherwise retains the benefits of the conventional gas jet cleaning approach.

In accordance with the invention, a method for cleaning fabrics comprises the steps of providing a piece of fabric having soil therein, and contacting the piece of fabric with a jet of an ionized soil-dislodging gas to dislodge the soil therefrom. Desirably, dislodged soil material is captured by an electrostatic filter to prevent it from redepositing on the fabric. The technique may be used in conjunction with an electrostatic spotting compound that concentrates the effect of the ionized gas, or more generally without such an electrostatic spotting compound.

An associated apparatus for cleaning a fabric having soil therein comprises a container having an interior in which the fabric is received, a gas jet nozzle directed into the interior of the container, a source of a pressurized gas communicating with an inlet of the gas jet nozzle, a gas jet manifold extending from the source to the gas jet nozzle, and a gas ionizer disposed to ionize the pressurized gas passing through the gas jet nozzle. The gas ionizer preferably comprises a corona discharge source. The gas ionizer is preferably positioned in the gas jet manifold, but it may be positioned at any location where it is effective in at least partially ionizing the gas flow. Desirably, an electrostatic filter charged oppositely to the ions captures dislodged soil material and prevents it from redepositing on the fabric.

The pressurized gas preferably flows at a pressure drop of from about 30 to about 300 pounds per square inch, gauge (psig), but may be pressurized at pressures of up to about 1000 psig for some applications. The method and apparatus are otherwise desirably operated at ambient pressure. The contact of the pressurized gas to the fabric dislodges particulate soil. Non-particulate soil may be mobilized and/or particulated with a spotting compound. The spotting compound is selected to enhance the effect of the ionized gas in dislodging the particles from the fabric. Once the soil is dislodged and entrained into the gas, the electrostatic charge imparted to the soil particles aids in repelling them from the fabric, aids in preventing their redeposition onto the fabric before they may be filtered from the gas, and aids in their capture by the electrostatic filter.

The result of this approach is an improvement in the efficiency of removing soil from the fabric. The fabric is cleaned more rapidly and effectively than in the absence of the ionization of the cleaning gas. The present approach, when operated at ambient pressure, adds little to the capital and operating costs of the apparatus and method. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIGS. 4A and 4B illustrate the removal mechanism of soil from fabric, wherein FIG. 4A illustrates the ionization and FIG. 4B represents the removal of the soil;

FIGS. 5A and 5B illustrate the removal mechanism of soil from fabric with the aid of an electrostatic spotting compound, wherein FIG. 5A illustrates the ionization and FIG. 5B represents the removal of the soil; and FIG. 6 is a perspective view of the perforated cylinder showing the relative positions of the notches and manifolds.

DETAILED DESCRIPTION OF THE INVENTION

Figure 1:
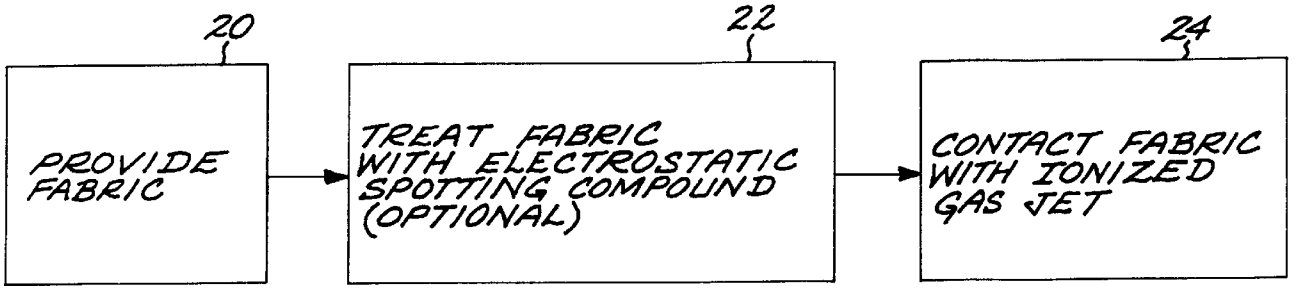
FIG. 1 is a block flow diagram of an approach for practicing the present invention.

FIG. 1 depicts a preferred approach for practicing the fabric cleaning method of the invention. A piece of fabric is provided, numeral 20. The fabric may be of any operable type, including both woven and nonwoven fabrics. The fabric may be of a wide variety of weights and thread densities. Typically, the greater the weight and the greater the thread density, the higher the pressure drop across the gas jet nozzles utilized in a subsequent step.

The fabric is optionally treated with an electrostatic spotting compound, numeral 22. The fabric may have a region of non-particulate soil, or may have a region with an especially heavy local concentration of a particulate soil. The spotting compound is used to treat such regions to reduce their resistance to dislodging of the soil and/or to chemically alter the soil. The selected compound also aids in concentrating the effect of the ionized gas used in a subsequent step. Examples of operable electrostatic spotting compounds include silicone compounds (such as silicone emulsions, anionically stabilized water-based silicone elastomers, methyl hydrogen silicone, cationic SiOH functional compounds) and polytetrafluoroethylene compounds (such as Caled Water and Stain Repellent made by Caled Co.). Such chemicals adhere to the soil spot and hold the charge of the ions contacted to the spot. The combined action of the chemicals, the momentum of the gas jets, and the repulsion of the ionized gas aid in repelling the soil of the spot from the fabric, thereby dislodging the soil from the fabric. The electrostatic spotting compound is typically applied locally to the fabric, where there is a noticeable spot of soil.

The electrostatic spotting compound is often furnished as a liquid, but it is used only to moisten the fabric and not as a general cleaning medium as is water in a conventional washing machine.

The fabric is treated with the electrostatic spotting compound, step 22, by any operable approach. Typically, the electrostatic spotting compound is applied to the fabric by spraying, dipping, rubbing, or other operable approach that achieves full contact of the compound to the fabric. The electrostatic spotting compound is typically applied prior to placing the fabric into the cleaning apparatus. The electrostatic spotting compound is allowed to remain in contact with the fabric for a period of time to permit it to react with the soil of the spot. The length of time required for the electrostatic spotting compound to function depends upon the compound, the nature of the fabric, and the type and concentration of the soil.

The treated fabric is contacted with a gas jet of an ionized particle-dislodging gas, numeral 24. The gas jet dislodges and expels the soil particles from the fabric, causing them to separate from the fabric. The dislodged particles include both the soil initially present as particles, and any soil that is converted from a non-particulate form to a particulate form by the treatment in step 22. This simultaneous removal of the original particulate soil and the particulated non-particulate soil provides a significant improvement and advantage over the conventional dry-cleaning approach. Conventional dry cleaning practice requires that the spotting to remove non-particulate soils be completed first, followed by the general dry cleaning operation to remove particulate soils. In the present case, the treated fabric is agitated by the gas jet in a single operation to remove both the non-particulate soil and the particulate soil, reducing cleaning time and costs.

The ionized particle-dislodging gas forming the gas jet may be of any operable gas and at any operable gas pressure. Operable gases include air (which is preferred), a major component of air such as nitrogen or oxygen, carbon dioxide, water, nitrogen oxide, carbon monoxide, chlorine, bromine, iodine, nitrous oxide, sulfur dioxide, and mixtures thereof, or any other gas (including gas mixtures) having an ionization potential of less than about 14 electron volts at atmospheric pressure and room temperature. The particle-dislodging gas is preferably furnished and used in the gaseous phase, which is usually its most inexpensive form. The particle-dislodging gas may instead be furnished in a condensed solid or liquid phase, and then vaporized prior to ionization. The preferred gas pressure drop across the gas jet nozzle is from about 30 pounds per square inch, gauge (psig) to about 300 psig, although pressures up to about 1000 psig may be used in some cases such as heavy fabrics.

The particle-dislodging gas is at least partially ionized. In ionization, initially neutral gas molecules are dissociated to form a positively charged portion and a negatively charged portion. Techniques and apparatus to accomplish the ionization of gas flows are well known in the art for other purposes, and may be utilized here as well. A preferred ionization technique and apparatus will be described subsequently.

The duration of the contacting step 24 depends upon the nature of the apparatus used, the nature and extent of the soiling, and the size of the load of fabric being processed. Typically for a normal load of fabric in the apparatus discussed next in relation to FIG. 2, the exposure time is from about 30 seconds to about 5 minutes. This exposure time is considerably shorter than required for conventional dry cleaning or wet washing, and the fabric leaves the processing dry and fresh smelling.

Additives may be introduced during the contacting step 24. For example, an odorizing compound may be contacted to the fabric to impart a pleasant odor to the fabric. Examples of odorizing compounds are perfumes, and essential natural or synthetic oils.

An anti-static compound may be introduced at the end of the contacting step 24 to dissipate the electrostatic charges remaining at the end of the step 24. The antistatic compound is entrained into the gas jets of the particle-dislodging gas or introduced separately. The anti-static compound aids in dissipating the static electricity intentionally generated by the use of the ionized gas earlier in the contacting step, and other static electricity generated during the cleaning process. The static electricity, if not dissipated in this way, tends to cause the fabric to adhere to itself, resulting in twisting of the fabric. Examples of operable anti-static compounds include, but are not limited to, alcohol ethoxylates, alkylene glycol, or glycol esters.

Other additives as desired, such as soaps and sizing agents, may also be introduced during the step of contacting 24.

Figure 2:
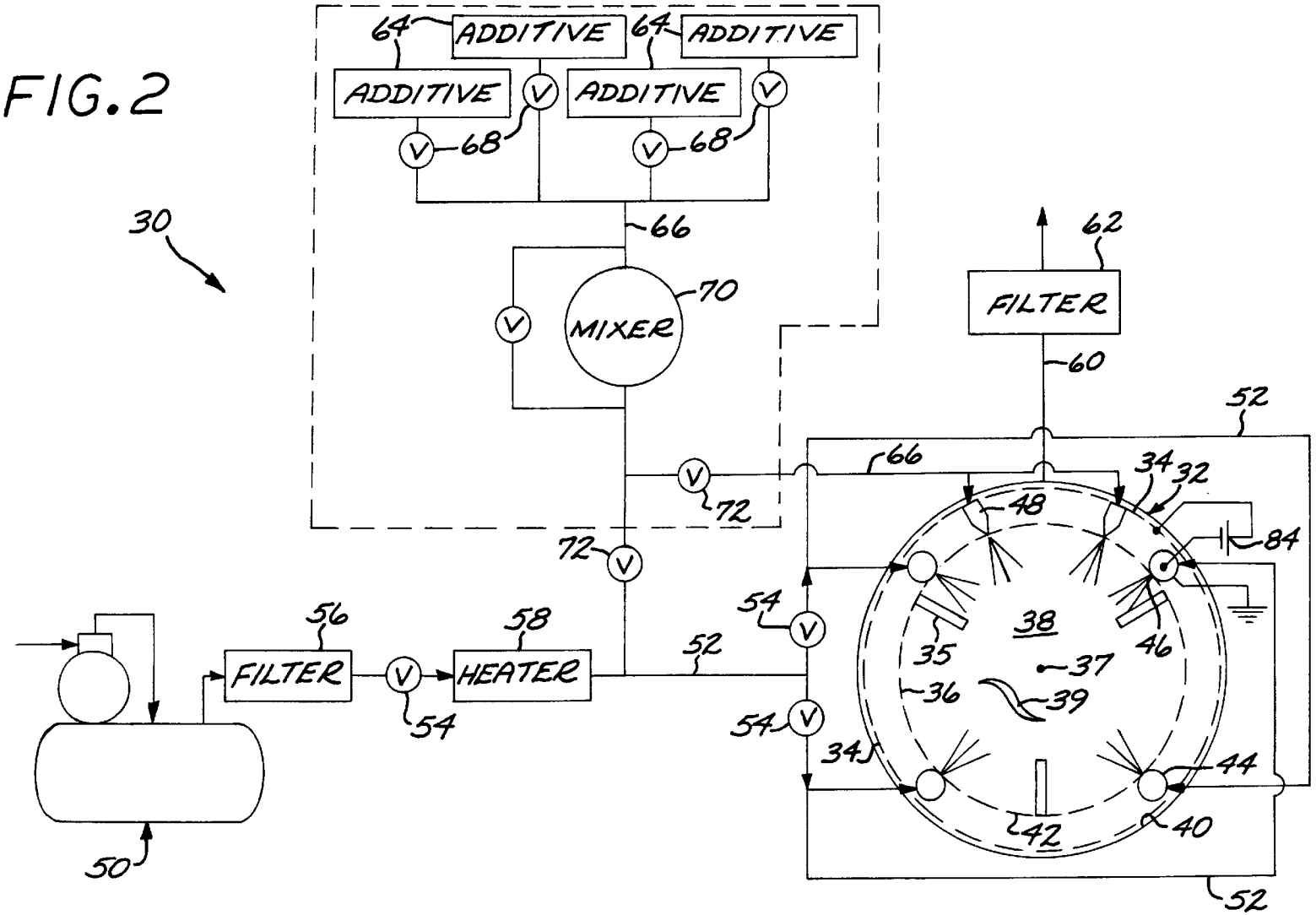
FIG. 2 is a diagrammatic view of an apparatus for agitating fabric with a gas jet at the fabric.

The present inventors are interested in commercial and home application of the invention, and a practical commercial and home apparatus 30 that may be used in the contacting step 24 is illustrated in FIG. 2. The apparatus 30 includes a contacting chamber 32 with a perforated basket 36 therein. The perforated basket may be coated with an electrically nonconducting material such as polytetrafluorethylene. The contacting chamber 32 and the perforated basket 36 are cylindrical in cross section with a cylindrical axis 37 (extending out of the plane of the illustration). The perforated basket 36 is smaller in cylindrical diameter than the contacting chamber 32. Optionally but preferably, a stationary electrostatic filter 34 in the form of a wire mesh cylinder coaxial with the cylindrical axis 37 is located outside the perforated basket 36 but within the contacting chamber 32. The stationary electrostatic filter 34 aids in capturing charged particles removed from the fabric being cleaned to prevent their redeposition on the fabric, in a manner to be described subsequently.

The perforated basket 36 may optionally be mounted on a rotational support for rotation about the cylindrical axis 37 and provided with a rotation drive motor to permit it to be rotated in the manner of a conventional clothes dryer. This rotational movement of the perforated basket 36 provides an agitation to the fabric within the perforated basket 36, in addition to the movement produced by the contacting of the pressurized gas flow to the fabric. When such a rotational capability is provided, during the contacting step 24 of the present invention the perforated basket 36 may optionally be locked into a fixed position, or the perforated basket 36 may be rotated while the gas jets function. Garment paddles 35 may also be provided as projections extending inwardly from the perforated basket into its interior 38. These garment paddles 35 enhance the movement of the fabric, aid in separating the individual articles within the interior of the basket 36, and prevent the individual articles from twisting together and interfering with the particle dislodging by the gas jets. There may also be provided a cabinet that encloses the contacting chamber 32, and an exterior door in the cabinet to allow access to the interior 38 of the perforated basket 36.

A piece of fabric 39 which is to be agitated by the gas jets is placed into the interior 38 of the perforated basket 36. Typically, several pieces of fabric are cleaned at once. All or some of the pieces may have been treated with the electrostatic compound in step 22, but all of the pieces of fabric need not have been treated the same way in respect to step 22.

Positioned between an inner surface 40 of the contacting chamber 32 and an outer surface 42 of the perforated basket 36 is at least one, and preferably several, gas jet manifolds 44 (or, equivalently, individual gas jets, not shown) In the preferred cylindrical design, the gas jet manifolds 44 extend parallel to the cylindrical axis 37. The manifolds 44 (or individual gas jets) may be affixed to the outer surface 42 of the perforated basket 36, affixed to the inner surface 40 of the contacting chamber 32, or separately supported. Preferably, the manifolds 44 (or individual gas jets) are affixed to the inner surface 40 of the contacting chamber 32, or separately supported.

A number of gas jet nozzles 46 are provided in each manifold 44 (or as the termination of individual gas jets), with the gas flows from the nozzles 46 directed inwardly into the interior 38 of the perforated basket 36. To accommodate this configuration, circumferential notches 36*a,* shown in FIG. 6, extend through the perforated basket 36 perpendicular to the cylindrical axis 37 so that the high pressure gas emitted from the gas jet nozzles 46 or the gas jets does not contact the wall of the perforated basket 36 and lose its momentum, and instead is directed fully against the fabric 39. The manifolds 44, gas jet nozzles 46, and garment paddles 35 are positioned to promote reversible garment agitation to prevent garment roping, tangling, and strangling during the contacting step 24. Rotation of the perforated basket 36 about the axis 37 and the presence of the garment paddles 35 can also aid in this effort. In the contacting step 24, the particle-dislodging gas flows through the manifolds 44, through the nozzles 46, and into the interior 38 of the perforated basket 36 (by way of the notches 36*a*) to contact the fabric 39.

The gas stream that contacts the fabric 39 in the contacting step 24 is first partially or completely ionized before it contacts the fabric. The ionization of the gas stream preferably is accomplished prior to its passage through the gas jet nozzles 46, but it may be accomplished as the gas passes through the gas jet nozzles or even after the gas has passed through the gas jet nozzles 46 but before it contacts the fabric.

Figure 3:
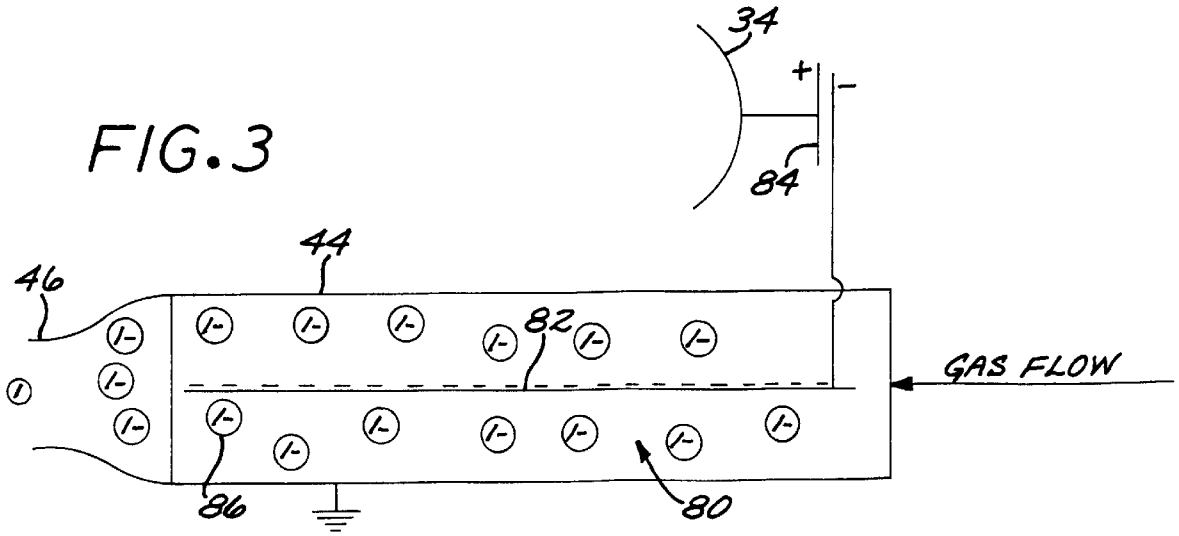
FIG. 3 is a schematic sectional view of a gas jet manifold, illustrating the gas ionizer.

FIG. 3 illustrates a preferred ionization device, a corona generator 80 located within the gas jet manifold 44 that ionizes the gas flow just before it passes through the gas jet nozzle 46. To ionize the gas, an electrode 82 is placed within the interior of the gas jet manifold 44. The electrode 82 is preferably a wire supported by insulators along the axial center of the manifold 44. In the illustrated embodiment, the wall of the manifold 44 is electrically grounded. The electrode 82 is biased relative to the electrostatic filter 34 by a voltage source 84. The electrode 82 may be electrically negatively biased, as illustrated, or it may be electrically positively biased. The selection of the sense of the bias is made according to the nature of the particle-dislodging gas that is flowed, and whether its molecules may be negatively or positively ionized. For the case of air, the preferred gas, the molecules may be negatively biased, and a negative bias is applied to the electrode 82 as illustrated. The bias voltage applied to the electrode 82 is selected as required to produce ionization of the gas in the size of manifold used and for the selected gas, but is typically on the order of about 50,000 volts for the case of air. The biasing voltage applied by the voltage source 84 may be DC, AC, or a modified wave form such as a square wave. The negative ionization voltage applied to the electrode 82 produces a corona discharge within the gas flow through the interior of the gas flow manifold 44. The gas molecules flowing through the corona discharge produce negatively charged ions 86, in the case where air is used as the particle-dislodging gas.

Generally, a corona discharge is produced by a non-uniform electrostatic field such as between a thin wire or electrode 82 and a plate or tube such as the wall of the manifold 44. Application of a high voltage between the electrode 82 and the wall of the manifold 44 generates a region of high electric field strength, which in the presence of a gas results in an electric breakdown of the gas, causing it to become electrically conductive, or a corona. Thus, in the corona region, electrons are accelerated to a velocity sufficient to knock an electron from a molecule in the air upon collision and thereby create a positive ion and an electron. Within the corona region, this ionization takes place in a self-sustaining avalanche which produces a dense cloud of free electrons and positive ions around the electrode 82. There are two types of corona discharge that can be generated. The positive corona is generated with a center electrode 82 charged with a positive voltage and the wall of the manifold 44 has a charge which is relatively negative with respect to the center electrode 82. In this case electrons move rapidly to the center electrode 82 and the positive ions stream away from the center electrode 82 to the wall of the manifold 44 in a unipolar "ion wind" of positive ions. Alternatively, a negative corona is generated with the center electrode 82 charged with a negative voltage and the wall of the manifold 44 positive relative to the center electrode 82. In this case, electrons created in the gas are repelled toward the wall of the manifold 44. As the electrons flow away from the electrode 82, their velocity decreases due to the decreased field strength. As their velocity slows, the electrons ionize electronegative gases such as oxygen to form negative ions, which are repelled toward the wall of the manifold 44. Thus, for both positive and negative coronas, ions migrate from the electrode 82 to the wall of the manifold 44.

The ions 86, together with non-ionized gas molecules, flow through the gas flow nozzle 46 and into the interior 38 of the basket 36, to impact against the fabric 39. It is not required that the entire gas flow be ionized. Any non-ionized gas molecules that pass through the gas flow nozzle 46 simply accomplish conventional gas jet cleaning of the fabric, and no damage is done to the fabric. The density of ions 86 within the gas flow passing through the gas flow nozzle 46 is greater than zero and is typically about $10^5$ per cubic centimeter, but this density may vary over a wide range without adversely affecting the operability of the invention.

Preferably, at least one injector 48 is also provided and directed inwardly into the interior 38 of the perforated basket 36 through the notches 36*a*. As with the manifolds 44, it is preferred that the injectors 48 are affixed to the wall of the chamber 32 with the flows from the injectors 48 directed through the notches 36*a* in the perforated basket 36. Any additives, such as an anti-static compound and/or an odorizing compound, that are contacted to the fabric during the contacting step 24 may be introduced through the injectors 48. Such additives may instead be entrained into the particulate-dislodging gas and introduced through the nozzles 46.

The particulate-dislodging gas is pressurized by a compressor 50 (or supplied from a pressurized gas bottle or condensed gas source, not shown) and supplied to the manifolds 44 through a first piping system 52. The first piping system 52 includes manually operated or processor-controlled valves 54 to distribute the gas flow and, optionally, a filter 56 to filter the incoming gas and a heater 58 to heat the incoming gas to a desired temperature. The particulate-dislodging gas is pressurized by the compressor 50, flows through the first piping system 52 to the manifolds 44, is at least partially ionized, and is introduced into the interior 38 of the perforated basket 36 through the nozzles 46 by flow through the notches 36*a*. The gas flow contacts the fabric 39 to dislodge particles, and then contacts the electrostatic filter 34 and flows out of the contacting chamber 32 through an exit pipe 60. A mechanical particulate filter 62 removes the particulate from the gas flowing in the exit pipe 60 which had not already been captured by the electrostatic filter 34, so that it is not released into the air and the environment.

Additives such as soaps, sizing agents, anti-static compounds and/or odorizing compounds are supplied to the injectors 48 from additive sources 64 through a second piping system 66. The second piping system 66 includes manually operated or processor-controlled valves 68 to select the types, amounts, and timing of the additive addition, a mixer 70 as necessary, and manually operated or processor-controlled valves 72 to distribute the additives to the injectors 48 and/or to the manifolds 44 as desired. Any additives that are not reacted with the fabric in the interior 38 of the perforated basket 36 leave the contacting chamber 32 through the electrostatic filter 34 and the exit pipe 60, and are entrapped in the exit filter 62.

The operability of the present invention does not depend upon any particular mechanism of operation. FIGS. 4A, 4B, 5A, and 5B present schematic depictions of the manner in which the invention is believed to function, but these illustrations should not be interpreted as limiting of the invention.

FIG. 4A illustrates the effect of the use of the ionized gas on the piece of fabric 39 having soil particles 90 therein, and FIG. 4B shows the mechanism of the removal of the soil particles 90. As shown in FIG. 4A, ions 92, in this case negatively charged ions, migrate to and contact the fabric 39, giving it a negative static surface charge. Some of the ions 92 also contact and adhere to the soil particles 92, which assume a negative charge as a result. The negative charges repel each other, but the resulting force is typically not sufficient to itself dislodge the soil particles 92 from the fabric 39. Instead, the pressurized flow of gas tends to loosen and dislodge the soil particles 92 from the fabric 39. As shown in FIG. 4B, the negatively charged soil particles 92 are electrostatically repelled from the fabric 39, thereby accelerating their dislodging from the fabric 39 and also reducing their tendency to redeposit back on the fabric 39 before they can be swept out of the perforated basket 36 and to the electrostatic filter 34. The soil particles 92 are trapped on the electrostatic filter 34 to prevent their redeposition onto the fabric 39, and those which are not trapped flow to the exit pipe 60 and thence to the mechanical filter 62.

A similar mechanism is believed to be operable where the electrostatic spotting compound is used, as illustrated in FIGS. 5A and 5B. Ions, here the negatively charged ions 92, migrate to both the fabric 39 and to patches of the spotting compound 94, FIG. 4A, which both become negatively charged. The spotting compound had been previously applied in step 22 to absorb or particularize non-particulate soil in the fabric, and the patches of the spotting compound 94 therefore contain soil. The action of the pressurized gas loosens and dislodges the patch of the spotting compound 94, which is repelled from the fabric 39 so that it does not redeposit back upon the fabric. The spotting compound 94 is similarly trapped on the electrostatic filter 34, or swept out of the system to the filter 62. Although FIGS. 5A–5B do not show individual soil particles 90, in a usual case where a piece of fabric contains both soil particles 90 and has been spotted with patches of the spotting compound 94, both of the mechanisms of FIGS. 4A–4B and 5A–5B will be simultaneously operable.

In a preferred manner of operation, the fabric is treated in step 22, allowed to stand for a period of time to permit the electrostatic spotting compound to function, and then placed into the interior 38 of the perforated basket 36. The gas jets are operated by passing gas through the manifolds 44 and nozzles 46, agitating the fabric to dislodge particulate matter from the fabric, step 24. As the gas passes through the manifolds 44, it is ionized as discussed previously, so that the gas exiting the nozzles 46 is partially or fully ionized. The gas jets impacting upon the fabric promote the particle expulsion from the fabric, both by physical and electrostatic mechanisms. Redeposition of soil on the fabric is discouraged by the capturing of the particulate on the electrostatic filter 34, which carries a charge opposite to that of the charged soil particles, thereby increasing the efficiency and speed of the cleaning operation. The additives, where used, are added through the injectors 48 as appropriate. The particulate matter dislodged from the fabric is entrained into the gas flow leaving the perforated basket 36, where it is attracted to and retained upon the electrostatic filter 34. The gas flow and any remaining particulate matter not retained on the electrostatic filter 34 leaves the contacting chamber 32 and passes into the exit pipe 60, where the remaining particulate matter is entrapped in the exit filter 62. After the fabric is cleaned and the corona generator 80 is turned off, an anti-static compound may be introduced to negate the electrostatic effects utilized in the cleaning operation.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for cleaning fabrics, comprising the steps of:

providing a piece of fabric having soil therein;

providing a flow of a soil-dislodging gas;

providing an electrically charged ionizing device;

passing the flow of the soil-dislodging gas through the ionizing device to charge the soil-dislodging gas either positively or negatively;

forming a jet of the ionized soil-dislodging gas; and contacting the piece of fabric with the jet of the ionized soil-dislodging gas to dislodge the soil from the fabric and to impart a net charge of the same sign to both the fabric and the soil so as to assist in electrostatically repelling the soil from the fabric.

2. The method of claim 1, wherein the soil-dislodging gas is selected from the group consisting of air, nitrogen, oxygen, carbon dioxide, water, nitrogen oxide, carbon monoxide, chlorine, bromine, iodine, nitrous oxide, and sulfur dioxide, and mixtures thereof.

3. The method of claim 1, wherein the soil-dislodging gas comprises a gas having an ionization potential of less than about 14 electron volts at atmospheric pressure and temperature.

4. The method of claim 1, wherein the step of contacting includes the step of contacting the piece of fabric with the jet of the ionized soil-dislodging gas passed through a nozzle with a pressure drop of from about 30 to about 300 pounds per square inch.

5. The method of claim 1, including an additional step, performed concurrently with the step of contacting, of agitating the piece of fabric in addition to the movement produced by the contacting of the gas jet to the fabric.

6. The method of claim 1, including an additional step, performed simultaneously with the step of contacting, of filtering the soil from the soil-dislodging gas.

7. The method of claim 1, including an additional step, performed simultaneously with the step of contacting, of removing the soil from the soil-dislodging gas with an electrostatic filter charged oppositely to that of the ionized soil-dislodging gas.

8. The method of claim 1, wherein the step of providing a piece of fabric includes the step of providing a contacting chamber, and placing the piece of fabric loose within the interior of the contacting chamber.

9. A method for cleaning fabrics, comprising the steps of:

providing a piece of fabric having soil therein;

treating at least a portion of the piece of fabric with an electrostatic spotting compound;

providing a flow of a soil-dislodging gas;

providing an electrically charged ionizing device;

passing the flow of the soil-dislodging gas through the ionizing device to charge the soil-dislodging gas either positively or negatively;

forming a jet of the ionized soil-dislodging gas; and contacting the piece of fabric with the jet of the ionized soil-dislodging gas to dislodge the soil from the fabric and to impart a net charge of the same sign to both the fabric and the soil so as to assist in electrostatically repelling the soil from the fabric.

10. The method of claim 9, wherein the soil-dislodging gas is selected from the group consisting of air, nitrogen, oxygen, carbon dioxide, water, nitrogen oxide, carbon monoxide, chlorine, bromine, iodine, nitrous oxide, and sulfur dioxide, and mixtures thereof.

11. The method of claim 9, wherein the electrostatic spotting compound is selected from the group consisting of a silicone compound and a polytetrafluoroethylene compound.

12. The method of claim 9, including an additional step, performed concurrently with the step of contacting, of agitating the piece of fabric.

13. The method of claim 9, including an additional step, performed simultaneously with the step of contacting, of filtering the soil from the soil-dislodging gas.

14. The method of claim 9, including an additional step, performed simultaneously with the step of contacting, of removing the soil from the soil-dislodging gas with an electrostatic filter charged oppositely to that of the ionized soil-dislodging gas.

* * * * *